US009756913B1

(12) United States Patent
Zepeda

(10) Patent No.: US 9,756,913 B1
(45) Date of Patent: Sep. 12, 2017

(54) CARD AND MONEY HOLDER WITH A MAGNIFYING LENS

(71) Applicant: Lori A. Zepeda, Modesto, CA (US)

(72) Inventor: Lori A. Zepeda, Modesto, CA (US)

( * ) Notice: Subject to any disclaimer, the term of this patent is extended or adjusted under 35 U.S.C. 154(b) by 186 days.

(21) Appl. No.: 14/844,589

(22) Filed: Sep. 3, 2015

(51) Int. Cl.
*A45C 1/06* (2006.01)

(52) U.S. Cl.
CPC ..... *A45C 1/06* (2013.01); *A45C 2001/065* (2013.01)

(58) Field of Classification Search
CPC ..... A45C 1/06; A45C 2001/065
See application file for complete search history.

(56) References Cited

U.S. PATENT DOCUMENTS 3,659,640 A * 5/1972 Fenster ..... A45C 1/06 150/147
3,994,328 A * 11/1976 Reis ..... A45C 1/08 150/143
4,153,093 A * 5/1979 Mahabir ..... A45C 1/00 150/106
4,805,680 A 2/1989 Ueno
4,863,026 A 9/1989 Perkowski
4,945,961 A * 8/1990 Healy ..... A45C 1/06 150/132
6,017,062 A * 1/2000 White ..... B42D 5/042 281/29
6,427,837 B1 8/2002 Shields
7,277,241 B1 * 10/2007 Fulton ..... G02B 27/021 281/31

* cited by examiner

*Primary Examiner* — Tri Mai
(74) *Attorney, Agent, or Firm* — Stevenson IP, LLC

(57) ABSTRACT

A card and money holder with a magnifying lens including a carrying case having a pair of flaps foldably and continuously attached along a middle crease, a magnifying lens hingedly attached to the middle crease between an interior surface of each of a front flap and a back flap of the pair of flaps. A zipper has a male member and a female member continuously attached to an outer edge of the front flap and the back flap, respectively. The male member is configured to slidingly engage the female member to securely attach the front flap to the back flap. At least one single slit is horizontally disposed within the interior surface of the front flap and, alternately, the interior surface of the back flap. A plurality of slits is horizontally and medially disposed within the interior surface of each of the front flap and the back flap.

5 Claims, 3 Drawing Sheets

CARD AND MONEY HOLDER WITH A MAGNIFYING LENS

BACKGROUND OF THE INVENTION

Various types of card and money holders are known in the prior art. However, what has been needed is a card and money holder with a magnifying lens including a carrying case having a pair of flaps foldably and continuously attached along a middle crease, a magnifying lens hingedly attached to the middle crease between an interior surface of each of a front flap and a back flap of the pair of flaps, and a zipper configured to securely attach the front flap to the back flap. What has been further needed is at least one single slit horizontally disposed within the interior surface of the front flap and, alternately, the interior surface of the back flap, and a plurality of slits horizontally and medially disposed within the interior surface of each of the front flap and the back flap.

The magnifying lens hingedly attached to the middle crease of the carrying case enables a user with poor vision to better read and locate his identification card, credit cards, and cash within the carrying case. Since a length of the magnification lens substantially conforms to a length of the carrying case, the user can better read the print located on any card disposed within the plurality of slits on the front flap and the back flap of the carrying case. The plurality of slits is configured to be disposed in varying arrangements on the interior surface of each of the front flap and the back flap depending on whether the carrying case is intended for use by a male user and, alternately, a female user. Lastly, one of a plurality of tabs is medially attached to one of the plurality of slits in order to assist the user in locating and storing a plurality of credit cards. For each one of the plurality of tabs, a color-coded matching adhesive tab can be affixed to one of the plurality of credit cards in order to more quickly and efficiently locate the credit card within the carrying case.

FIELD OF THE INVENTION

The present invention relates to card and money holders, and more particularly, to a card and money holder with a magnifying lens.

SUMMARY OF THE INVENTION

The general purpose of the present card and money holder with a magnifying lens, described subsequently in greater detail, is to provide a card and money holder with a magnifying lens which has many novel features that result in a card and money holder with a magnifying lens which is not anticipated, rendered obvious, suggested, or even implied by prior art, either alone or in combination thereof.

To accomplish this, the present card and money holder with a magnifying lens includes a carrying case having a pair of flaps foldably and continuously attached along a middle crease. Each of the pair of flaps includes a front flap and a back flap. Each of the front flap and the back flap has an exterior surface, an interior surface, a top edge, a right edge, a left edge, and a continuous outer edge disposed along the top edge, the right edge, and the left edge. A width of the front flap is equal to a width of the back flap. A length of the front flap is equal to a length of the back flap. A magnifying lens is hingedly and continuously attached to the middle crease between the interior surface of the front flap and the interior surface of the back flap. A length of the magnifying lens substantially conforms to a length of the carrying case.

A width of the magnifying lens substantially conforms to a width of one of the pair of flaps. Each of the pair of flaps and the magnifying lens are optionally rectangular.

A zipper has a male member and a female member. The male member is continuously attached to the outer edge of the front flap, and the female member is continuously attached to the outer edge of the back flap. The male member is configured to slidingly engage the female member to securely attach the front flap to the back flap. At least one single slit is horizontally disposed within the interior surface of the front flap and, alternately, the interior surface of the back flap proximal the top edge. A plurality of slits is horizontally and medially disposed within the interior surface of each of the front flap and the back flap between the right edge and the left edge. One of a plurality of tabs is medially attached to one of the plurality of slits. The at least one slit is configured to removably secure a plurality of dollar bills within the at least one slit. One of the plurality of slits is configured to removably secure one of a plurality of credit cards within one of the plurality of slits. The plurality of slits optionally further includes a pair of the plurality of slits. The plurality of slits in each of the pair of the plurality of slits is optionally three.

Thus has been broadly outlined the more important features of the present card and money holder with a magnifying lens so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
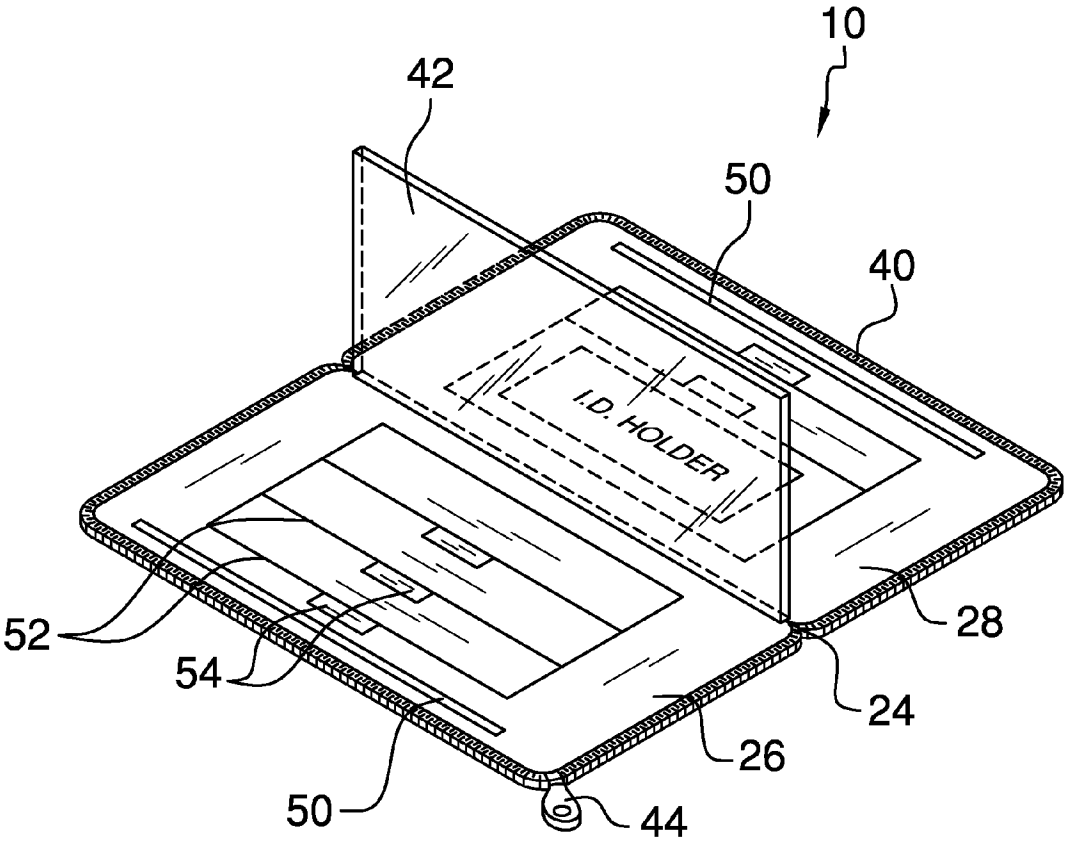
FIG. 1 is a front isometric view.
Figure 2:
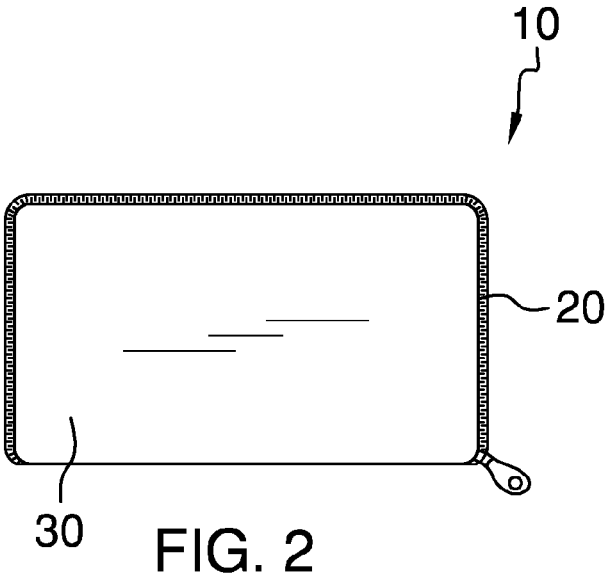
FIG. 2 is a top plan view showing a male member of a zipper pull tab slidingly engaged with a female member of the zipper pull tab.
Figure 3:
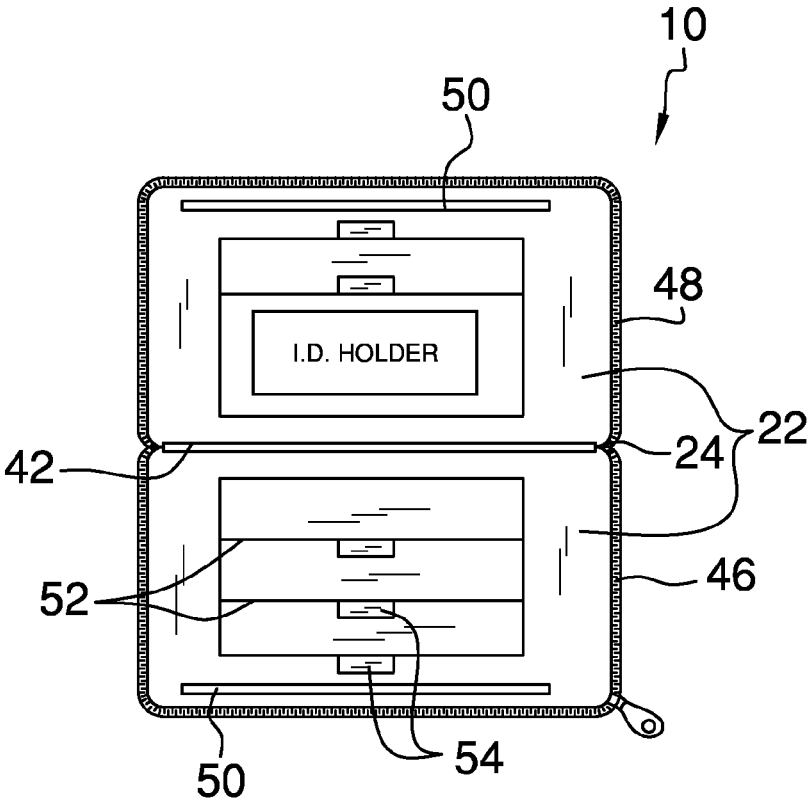
FIG. 3 is a top plan view showing a plurality of slits.
Figure 4:
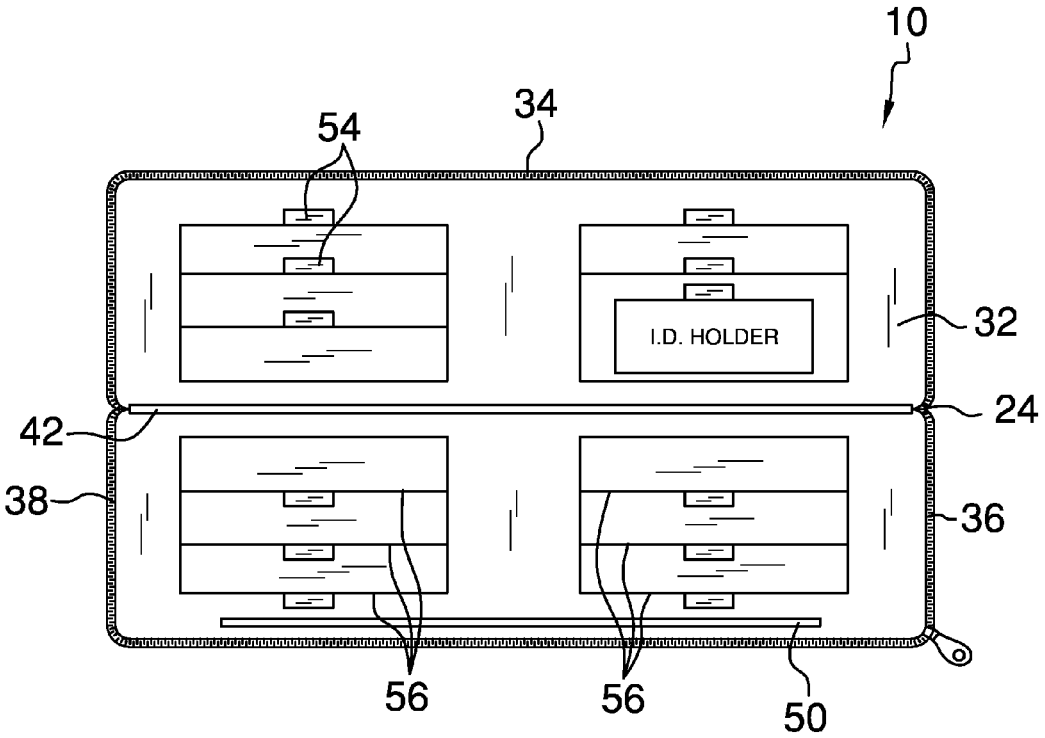
FIG. 4 is a top plan view showing a pair of the plurality of slits.

With reference now to the drawings, and in particular FIGS. 1 through 4 thereof, an example of the instant card and money holder with a magnifying lens employing the principles and concepts of the present card and money holder with a magnifying lens and generally designated by the reference number 10 will be described.

Referring to FIGS. 1 through 4 the present card and money holder with a magnifying lens 10 is illustrated. The card and money holder with a magnifying lens 10 includes a carrying case 20 having a pair of flaps 22 foldably and continuously attached along a middle crease 24. Each of the pair of flaps 22 includes a front flap 26 and a back flap 28. Each of the front flap 26 and the back flap 28 has an exterior surface 30, an interior surface 32, a top edge 34, a right edge 36, a left edge 38, and a continuous outer edge 40 disposed along the top edge 34, the right edge 36, and the left edge 38. A magnifying lens 42 is hingedly and continuously attached to the middle crease 24 between the interior surface 32 of the front flap 26 and the interior surface 32 of the back flap 28.

A zipper 44 has a male member 46 and a female member 48. The male member 46 is continuously attached to the outer edge 40 of the front flap 26, and the female member 48 is continuously attached to the outer edge 40 of the back flap 28. At least one single slit 50 is horizontally disposed within the interior surface 32 of the front flap 26 and, alternately, the interior surface 32 of the back flap 28 proximal the top edge 34. A plurality of slits 52 is horizontally and medially disposed within the interior surface 32 of each of the front flap 26 and the back flap 28 between the right edge 36 and the left edge 38. One of a plurality of tabs 54 is medially attached to one of the plurality of slits 52. The plurality of slits 52 optionally further includes a pair of the plurality of slits 56. As best shown in FIG. 5, the plurality of slits 52 in each of the pair of the plurality of slits 56 is optionally three.

What is claimed is:

1. A card and money holder with a magnifying lens comprising:

a carrying case having a pair of flaps foldably and continuously attached along a middle crease, each of the pair of flaps comprising a front flap and a back flap, each of the front flap and the back flap having an exterior surface, an interior surface, a top edge, a right edge, a left edge, and a continuous outer edge disposed along the top edge, the right edge, and the left edge;

wherein a width of the front flap is equal to a width of the back flap;

wherein a length of the front flap is equal to a length of the back flap;

a magnifying lens hingedly and continuously attached to the middle crease between the front flap interior surface and the back flap interior surface;

wherein a length of the magnifying lens substantially conforms to a length of the carrying case;

wherein a width of the magnifying lens substantially conforms to a width of one of the pair of flaps;

a zipper has a male member and a female member, wherein the male member is continuously attached to the front flap outer edge, and the female member is continuously attached to the back flap outer edge, wherein the male member is configured to slidingly engage the female member to securely attach the front flap to the back flap;

at least one single slit horizontally disposed within the interior surface of the front flap and, alternately, the back flap proximal the top edge;

a plurality of slits horizontally and medially disposed within the interior surface of each of the front flap and the back flap between the right edge and the left edge; and a plurality of tabs, wherein one of the plurality of tabs is medially attached to one of the plurality of slits;

wherein the at least one slit is configured to removably secure a plurality of dollar bills within the at least one slit;

wherein one of the plurality of slits is configured to removably secure one of a plurality of credit cards within one of the plurality of slits.

2. The card and money holder with a magnifying lens of claim 1 wherein each of the pair of flaps of the carrying case is rectangular.

3. The card and money holder with a magnifying lens of claim 2 wherein the magnifying lens is rectangular.

4. The card and money holder with a magnifying lens of claim 1 wherein the plurality of slits further comprises a pair of the plurality of slits, wherein the plurality of slits in each of the pair of the plurality of slits is three.

5. A card and money holder with a magnifying lens comprising:

a carrying case having a pair of flaps foldably and continuously attached along a middle crease, each of the pair of flaps comprising a front flap and a back flap, each of the front flap and the back flap having an exterior surface, an interior surface, a top edge, a right edge, a left edge, and a continuous outer edge disposed along the top edge, the right edge, and the left edge;

wherein a width of the front flap is equal to a width of the back flap;

wherein a length of the front flap is equal to a length of the back flap;

a magnifying lens hingedly and continuously attached to the middle crease between the front flap interior surface and the back flap interior surface;

wherein a length of the magnifying lens substantially conforms to a length of the carrying case;

wherein a width of the magnifying lens substantially conforms to a width of one of the pair of flaps;

wherein each of the pair of flaps of the carrying case is rectangular;

wherein the magnifying lens is rectangular;

a zipper has a male member and a female member, wherein the male member is continuously attached to the front flap outer edge, and the female member is continuously attached to the back flap outer edge, wherein the male member is configured to slidingly engage the female member to securely attach the front flap to the back flap;

at least one single slit horizontally disposed within the interior surface of the front flap and, alternately, the interior surface of the back flap proximal the top edge;

a pair of a plurality of slits horizontally and medially disposed within the interior surface of each of the front flap and the back flap between the right edge and the left edge; and a plurality of tabs, wherein one of the plurality of tabs is medially attached to one of the plurality of slits;

wherein the at least one slit is configured to removably secure a plurality of dollar bills within the at least one slit;

wherein one of the plurality of slits is configured to removably secure one of a plurality of credit cards within one of the plurality of slits.

* * * * *